US007238074B1

(12) United States Patent
Berndt et al.

(10) Patent No.: US 7,238,074 B1
(45) Date of Patent: Jul. 3, 2007

(54) CREW OVERBOARD RETRIEVAL SYSTEM

(76) Inventors: Larry K. Berndt, 140 Ln 840 Snow Lake, Fremont, IN (US) 46737; Paul W. Berndt, 750 E. Hickory Grove Rd., Port Clinton, OH (US) 43452

( * ) Notice: Subject to any disclaimer, the term of this patent is extended or adjusted under 35 U.S.C. 154(b) by 0 days.

(21) Appl. No.: 11/136,001

(22) Filed: May 24, 2005

Related U.S. Application Data

(60) Provisional application No. 60/574,301, filed on May 25, 2004.

(51) Int. Cl.
*B63C 9/00* (2006.01)

(52) U.S. Cl. ..... 441/80

(58) Field of Classification Search ..... 114/255; 441/80, 84, 85
See application file for complete search history.

(56) References Cited

U.S. PATENT DOCUMENTS 4,458,621 A * 7/1984 De Clifford ..... 114/255
4,652,246 A * 3/1987 Thorgeirsson et al. ..... 441/80
5,158,489 A * 10/1992 Araki et al. ..... 441/80
5,192,238 A * 3/1993 Brown ..... 441/84
5,370,565 A * 12/1994 Yanez ..... 441/80
5,374,211 A * 12/1994 Imazato ..... 441/84
5,484,313 A * 1/1996 Rachal et al. ..... 441/80

* cited by examiner

*Primary Examiner*—Stephen Avila
(74) *Attorney, Agent, or Firm*—Taylor & Aust, P.C.

(57) ABSTRACT

A crew overboard retrieval system for retrieving an object in the water including a flotation device, a net connected to the flotation device and a line connected to the net. A method of retrieving an object in the water, including the steps of: providing a crew overboard retrieval system including a flotation device, a net connected to the flotation device and a line connected to the net; connecting the line to a marine structure; deploying the crew overboard retrieval system in the water by casting off the flotation device and the net; at least partially encircling the object in the water with the net; capturing the flotation device; and retrieving the object in the water with the net.

18 Claims, 3 Drawing Sheets

CREW OVERBOARD RETRIEVAL SYSTEM

CROSS REFERENCE TO RELATED APPLICATIONS

This is a non-provisional application based upon U.S. provisional patent application Ser. No. 60/574,301, entitled "CREW OVERBOARD RETRIEVAL SYSTEM", filed May 25, 2004.

BACKGROUND OF THE INVENTION

1. Field of the Invention

The present invention relates to marine safety devices, and, more particularly, to marine crew overboard retrieval systems.

2. Description of the Related Art

Marine crew overboard situations are potentially a matter of life or death. Even if the overboard person has on a flotation device, an injury may have occurred before, as, or after the crew goes overboard which renders the overboard crew unconscious and/or unable to assist in their own recovery. When the temperature of the air (in ° F.) and the temperature of the water (in ° F.) add up to less than 100, the risk of hypothermia for an overboard person is likely. The average person in the water in such conditions and without a survival suit may only have about fifteen minutes or less prior to the onset of severe hypothermia progressing quickly to unconsciousness and death. If the overboard crew is injured, the injury itself may pose a severe risk to the overboard person if not treated quickly, thereby further necessitating a quick recovery of the overboard crew.

The phenomena of "dry drowning" is known where cold water inadvertently swallowed by an overboard person can cause their esophagus to spasm making it difficult or impossible for the overboard person to breathe. A person can suffocate and drown under such conditions even though their head is out of the water. Obviously, in wave conditions particularly, the longer a person is in the water the more likely they are to swallow water.

It is quite common for recreational boaters to not have on a flotation device even though the flotation devices are at hand on the boat. Additionally, many such boaters have limited or effectively no swimming skills. If such a person goes overboard, even in the calmest of conditions, the threat of drowning is immediate.

Unlike driving a land vehicle, there are no licensing and/or training required of a recreational boat operator. While excellent training is available for recreational boaters, much of it is in a classroom setting and therefore does not include hands on exercises. The hands on training available to boaters is taken by relatively few recreational boaters. Exacerbating the limited training on the part of the crew and/or skipper is the conditions under which a person is likely to go overboard. High winds and waves can challenge any movement or action on a boat and make the boat difficult to handle even for a captain and crew well seasoned. For example, typical hands on sailing classes, and standard sailing texts, teach a overboard crew drill where, a crew yells "man overboard" at the onset of a crew overboard, spots and points to the overboard crew; the spotter or another person throws the overboard crew additional flotation; the helmsman maneuvers the boat through a FIG. 8 to a downwind location near the overboard crew, being careful not to run over the overboard crew, and stops the boat; a line is thrown to the overboard crew; hopefully the overboard crew can get to the line and somehow stay connected therewith; the crew is hauled close to the boat; and finally, the overboard crew is hauled into the boat.

However, in the Great Lakes for example, expediently executing a typical man overboard drill in 3–5 foot waves and 20 knots of wind is close to impossible without risking further injury to the overboard crew by contact with the boat. Any boat has effectively no steerage if not underway. The combination of wind and waves, and the windage of the boat and rigging, make a boat difficult to stop at a precise location relative to the overboard crew. The difference in drift between the boat and overboard crew can be substantial, given the fact that even a relatively small boat may have hundreds of square feet of surface area impacted by the wind, even with no sail up, whereas an overboard crew will typically have less than one square foot impacted by the wind, given the fact that only their head will be above water. Additionally, the wind velocity increases as a function of distance above the water, so that the taller structure of the boat will have a greater wind impacting it compared to the close-to-the-water head of the overboard crew, thereby further increasing the difference in drift between the overboard crew and the boat. It is surprising how quickly the distance between a boat and an overboard crew can increase even with a 1–2 knot differential in drift between the boat and overboard crew. For example, for a 1 knot differential in drift between the boat and overboard crew, the distance between the boat and overboard crew will be increasing at about 100 feet per minute. Therefore, in a minute or less the overboard crew can quickly be out of reach of a throwing line, or if connected to the line, can be towed at 1–2 knots thereby making if difficult to breathe and stay connected to the throwing line.

The head of an overboard crew is a relatively small target to track in calm water, and in even small waves, can quickly disappear from sight behind a wave. If the waves start to cap, the overboard crew becomes even more difficult to see and can be continuously dunked by the capping waves. Capping waves with spray can obliterate the surface of the water thereby rendering visual contact with the head of the overboard crew very difficult.

Skipper and crew experience and training vary widely, but the skipper of a boat will typically have the most experience and training. Even so, the skipper may have not prepared the crew adequately for a crew overboard emergency. A typical scenario is that a boat is taken out for a leisurely cruise on an idyllic midsummer day, the cruisers are not paying close attention to the weather conditions, and a summer storm picks up quickly and overtakes the boat. Storm fronts can move as rapidly as 30–40 knots and can have winds in excess of 60 knots, which winds can quickly change the sea state, and the leisurely cruise is now a potential emergency situation. Conditions are rapidly changing, and in a worse case scenario, the skipper goes on deck without proper safety gear, such as personal flotation and a harness connected to a jackline, to adjust some rigging and a strong gust heals the boat sharply, and the combination of the force of the wind, the healing boat, and possibly a wave simultaneously hitting the boat, causes the skipper to lose balance and be knocked overboard. Now a crew which is not prepared for gale conditions finds itself in an emergency crew overboard rescue under storm conditions. It is easy to imagine how this crew would find it difficult to execute the multi-step crew overboard process described above, even if they knew what to do.

Another complicating factor can be a shorthanded crew. A skipper and single crew well trained in crew overboard drill can execute a single handed crew overboard in the event that the other person has gone overboard, however with increasing difficulty as conditions worsen. In difficult conditions the skipper, being the most experienced, may elect to leave the cockpit and go on the cabin top, for example, to adjust or secure rigging. The skipper is then more likely to be thrown overboard leaving the single handed crew to not only handle the boat in potentially difficult conditions, but also conduct an emergency rescue. If a crew finds themselves in such a scenario the single handed crew may develop a feeling of panic thereby adding difficulty to any rescue.

Slings are known for crew overboard rescue. The sling may be a flotation device in the shape of a closed horseshoe, for example, and attached to a line which is attached to the boat. The sling is thrown in the vicinity of the overboard crew, or thrown in the water and then maneuvered toward the overboard crew. Given that the sling has a lower profile than the head of the crew, it is easy to loose track of the sling and/or overboard crew while maneuvering the boat and attached sling toward the overboard crew while also maintaining a safe distance between the boat and overboard crew. In addition to the difficulty of maneuvering the sling to the reachable vicinity of the overboard crew, the overboard crew must be able to position the sling under their arms, which can be difficult for a fully conscious and uninjured overboard crew in high winds and/or a difficult sea state, and even more so difficult or impossible for an unconscious or injured overboard crew. For example, if an overboard crew is able to get hold of the sling, and then lifts the sling out of the water and over their head in order to place the sling around their upper body, a strong wind can tear the sling from their grip and push the sling substantially away from the overboard crew thereby necessitating further maneuvering of the boat and sling to reposition the sling near the overboard crew. Obviously, for an unconscious or injured overboard crew, the sling system holds little or no advantage in the retrieval of the crew. Such a scenario may require putting a rescue swimmer in the water to assist the unconscious or injured overboard crew with the sling. Even a strong swimmer with rescue training will find such a task difficult, particularly in difficult seas. Further, placing a rescue swimmer in the water may be the most dangerous option for typical recreational boating amateurs, relative to the safety of the crew and boat, particularly when there is only one crew onboard to begin with.

Another option is to radio in a mayday for a rescue operation executed by the Coast Guard, for example, but this option can be very costly. Calling in rescue professionals can also take some time to implement, depending on how far the nearest Coast Guard facility is from the rescue site, and what mode of transportation (sea and/or air) that the Coast Guard uses to convey itself to the rescue site. A person in the water may not be able to survive even a very prompt Coast Guard response, depending on how far away the rescue location is from the Coast Guard station.

What is needed in the art is a crew overboard retrieval system which can be used to safely and quickly retrieve an overboard crew in difficult conditions, even when shorthanded, and with a minimum of retrieving crew training and expertise, and which is affordable.

SUMMARY OF THE INVENTION

The present invention provides a crew overboard retrieval system which can be used to safely and quickly retrieve an overboard crew in difficult conditions, even when shorthanded, and with a minimum of retrieving crew training and expertise, and which is affordable.

The invention comprises, in one form thereof, a crew overboard retrieval system for retrieving an object in the water including a flotation device, a net connected to the flotation device and a line connected to the net.

The invention comprises, in another form thereof, a boat which includes a marine structure, and a crew overboard retrieval system attached to the marine structure. The crew overboard retrieval system includes a flotation device, a net connected to the flotation device and a line connected to the net.

The invention comprises, in another form thereof, a method of retrieving an object in the water, including the steps of: providing a crew overboard retrieval system including a flotation device, a net connected to the flotation device and a line connected to the net; connecting the line to a marine structure; deploying the crew overboard retrieval system in the water by casting off the flotation device and the net; at least partially encircling the object in the water with the net; capturing the flotation device; and retrieving the object in the water with the net.

An advantage of the present invention is that an overboard crew can be retrieved safely.

Another advantage of the present invention is that an overboard crew can be retrieved safely in difficult conditions including high seas and/or strong winds.

Yet another advantage of the present invention is that an overboard crew can be retrieved safely when the overboard crew is unconscious and/or injured.

A further advantage of the present invention is that an overboard crew can be retrieved safely under shorthanded conditions.

A further advantage of the present invention is that an overboard crew can be retrieved safely without the need for precise positioning of the boat relative to the crew overboard.

A further advantage of the present invention is that it is relatively easy to deploy and use.

A further advantage of the present invention is that it is relatively inexpensive to purchase and use.

A further advantage of the present invention is that it is relatively easy and inexpensive to maintain and keep ready.

A further advantage of the present invention is that it can be quickly and easily deployed.

A further advantage of the present invention is that it can quickly and efficiently retrieve an overboard crew.

Yet another advantage is of the present invention is that it can retrieve an overboard crew without putting a rescue swimmer in the water.

Yet another advantage is of the present invention is that it can retrieve an overboard pet and/or other objects.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
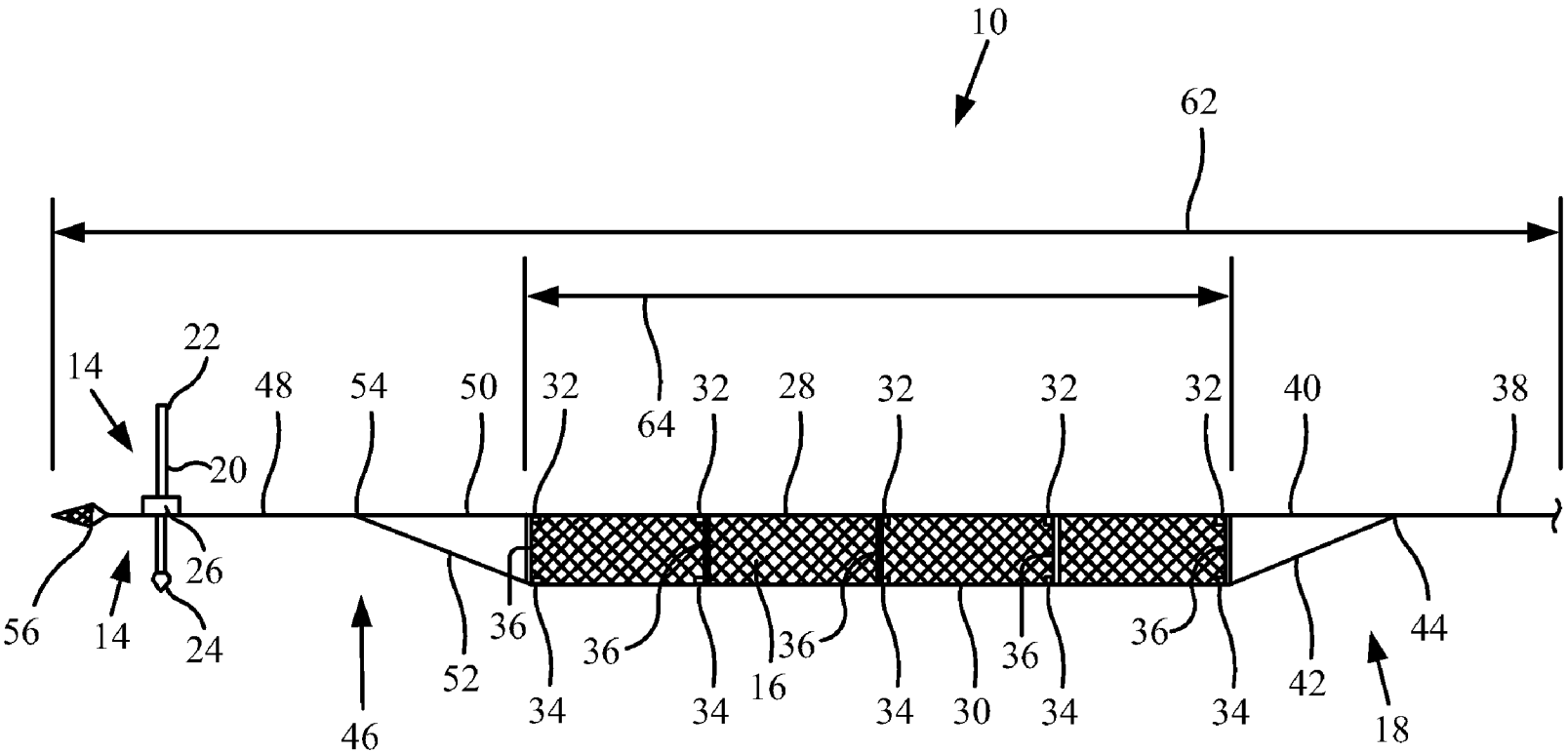
FIG. 1 is a front view of an embodiment of a crew overboard retrieval system according to the present invention.

Referring now to the drawings, and more particularly to FIG. 1, there is shown a crew overboard retrieval system 10, for retrieving an object in the water such as a person, which generally includes a flotation device 14, a net 16 connected to flotation device 14 and a line 18 connected to net 16. Although crew overboard retrieval system 10 is shown as retrieving person 12, crew overboard retrieval system 10 can also be used to retrieve other animate objects, such as an overboard pet, and also a multitude of inanimate objects such as overboard cargo, floating garbage, overboard apparel such as a hat, racing buoys, and other objects.

Flotation device 14 is shown as a float pole, and includes a longitudinal member 20 with a first end 22 and a second end 24, and a buoyant member 26 positioned between first end 22 and second end 24. Alternatively, flotation device 14 can be a buoy with a ring that can be hooked with a boat hook for example, or a styrofoam float that can be gaffed, or other designs.

Net 16 can include an upper extent 28 and a lower extent 30 opposite upper extent 28, at least one net float 32 connected to upper extent 28, and at least one net ballast 34 connected to lower extent 30. Net 16 can include at least one deployment tube 36 connected to net 16 and extending between upper extent 28 and lower extent 30. More particularly, at least one net float 32 and at least one net ballast 34 can comprise at least one float-ballast pair, and at least one deployment tube 36 can be positioned between the at least one float-ballast pair. Deployment tube 36 is not restricted to a vertical positioning, it can be positioned diagonally, for example. The material of net 16 can include rope (natural and man made fibers), webbing, plastic, wire (which may be more suitable for inanimate overboard objects) and/or other materials that are known in the art. Although net floats 32 and ballasts 34 are shown as being discrete elements, alternatively, net floats 32 can be a continuously buoyant element such as a floating polypropylene line along upper extent 28, and/or net ballasts 34 can be a continuously ballasted element such as a metal wire along lower extent 30. Further, net floats 32 and ballasts 34 can be a combination of discrete and continuous elements. Floats 32 keep upper extent 28 deployed near the surface of the water, ballasts 34 keep lower extent 30 deployed underwater and deployment tubes 36 keep net 16 from folding or curling on itself, particularly when net 16 is under tension. Bottom sections 42, 52 can help keep net 16 stay more vertical in the water to improve the probability of capture, retention and retrieval of an object.

Figure 2:
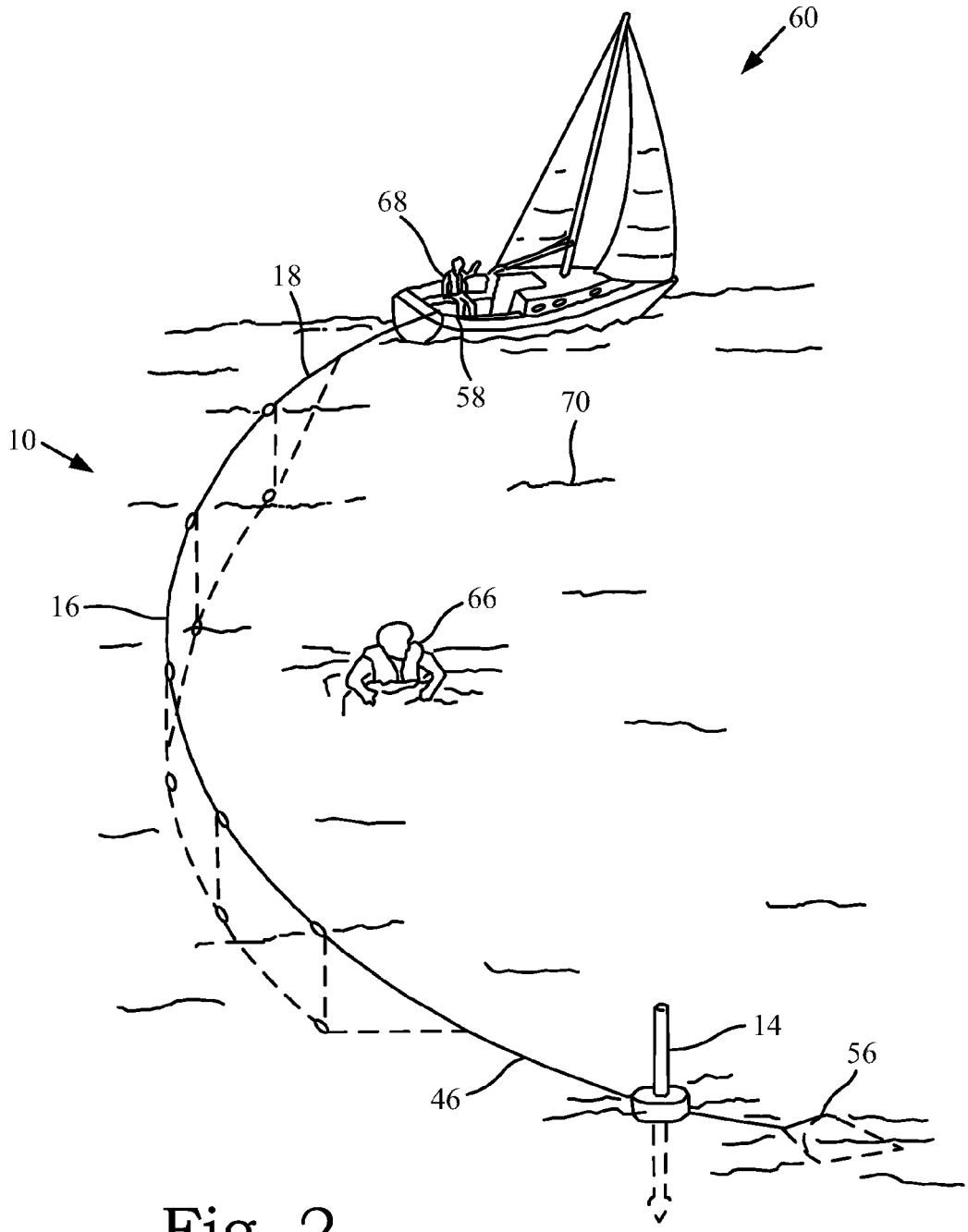
FIG. 2 is a perspective view of an embodiment of a boat with a crew overboard retrieval system deployed according to the present invention.

Line 18 can include a loose section 38, a top section 40 connected to upper extent 28 and a bottom section 42 connected to lower extent 30. Loose section 38, top section 40 and bottom section 42 can be connected at a Y junction 44. Loose section can terminate in an eye and/or shackle, a simple bitter end, or other terminations and/or hardware as is known in the marine arts. Referring to FIG. 2, loose section 38 is attached to part of a marine structure 58, such as a gunwale on boat 60, although loose section 38 can be advantageously attached to other marine structures. For example, retrieval system 10 can be connected at other marine structure such as a cleat or a winch on the boat, tackle connected to a boom, a davit, hoist, crane, bridge, toerail, grabrail, snatch block, hull, cockpit, or practically any other marine structure on the boat suitable and sufficiently strong for the purpose of attachment.

Crew overboard retrieval system 10 can further include a second line 46 connecting net 16 to flotation device 14. Second line 46 can include a float device section 48 connected to flotation device 14, a second top section 50 connected to upper extent 28 and a second bottom section 52 connected to lower extent 30. Flotation device section 48, second top section 50 and second bottom section 52 can be connected at a Y junction 54.

Crew overboard retrieval system 10 can further include a drogue 56 connected to flotation device 14.

Crew overboard retrieval system 10 of the present invention can be provided in different sizes to accommodate boats of different lengths and maneuverability. Crew overboard retrieval system 10 can come in an approximately 100 foot size that can be used with boats up to about 25 feet length overall. The 100 foot size can be made up of approximately a 20 foot loose section 38, a 15 foot top section 40, 30 feet of net 16, a 15 foot second top section 50, and a 20 foot flotation device section 48. Net 16 can have a height of 6 foot for example, but this height can vary depend on specific usage and can generally be in the approximate range of 1–10 feet. Another size of crew overboard retrieval system 10 is a 150 foot model that can be used with boats up to about 45 feet length overall, for example. The 150 foot model can be made up of approximately a 35 foot loose section 38, a 15 foot top section 40, 50 feet of net 16, a 15 foot second top section 50, and a 35 foot flotation device section 48. Another size of crew overboard retrieval system 10 is a 200 foot model that can be used with boats up to about 65 feet length overall, for example. The 200 foot model can be made up of approximately a 30 foot loose section 38, a 20 foot top section 40, 100 feet of net 16, a 20 foot second top section 50, and a 30 foot flotation device section 48. The crew overboard retrieval system of the present invention can be modified further to accommodate any size marine vessel. For example, a 300 foot model can be used for boats up to about 95 feet length overall; a 400 foot model can be used for boats up to about 125 feet length overall; etc. The dimensions given above do not limit the scope of the present invention, and specific dimensions can be customized for the specific boat type (sail, cabin cruiser, ski boat, trawler, commercial fishing, bass boat, pontoon, skiff, Great Lakes freighter, ocean freighter, Coast Guard cutter, rescue, tow, motorsailer, barge, tug, military vessel, water taxi, cruise, etc.), length, beam, draft and overall maneuverability, and further, can be customized as required by the user. Crew overboard retrieval system 10 has an overall length 62 and net has a net length 64, where a ratio of net length 64 to overall length 62 is approximately between 0.10 and 0.50.

Flotation device 14 can include a section of longitudinal member 20 above buoyant member 14 with a height which is easily reachable by an on board crew from the cockpit, for example, with such a height being six foot for example. However, this height can vary depending on the type of boat. A daysailer with low freeboard may only need a height of longitudinal member 20 above buoyant member 14 of approximately 2–3 feet or less. A large cabin cruiser may need a correspondingly larger height.

Figure 3:
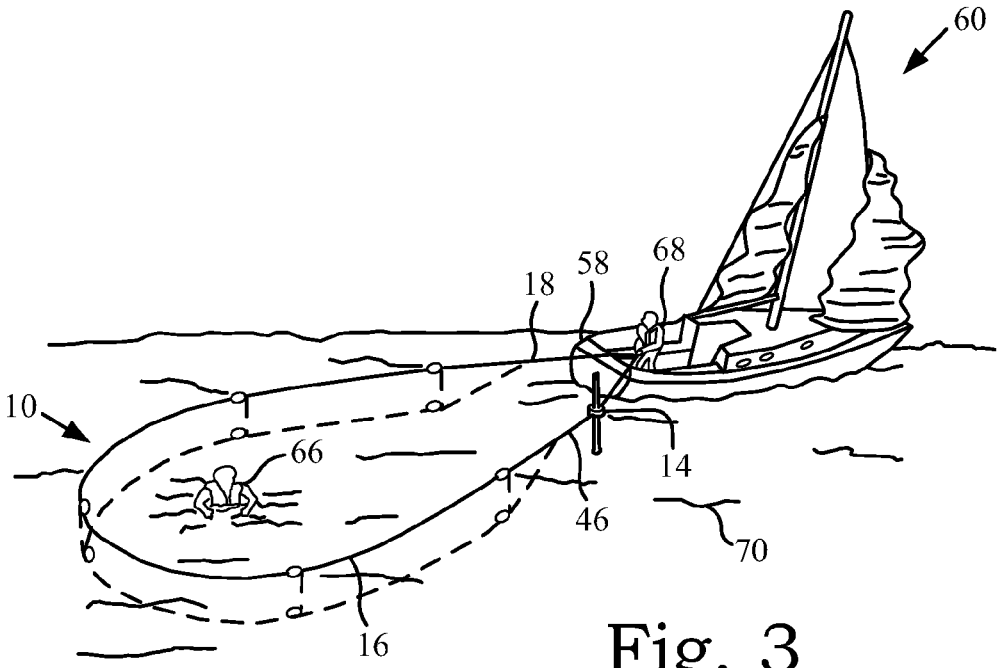
FIG. 3 is a perspective view of the embodiment of a boat with a crew overboard retrieval system of FIG. 2, having encircled the crew overboard.
Figure 4:
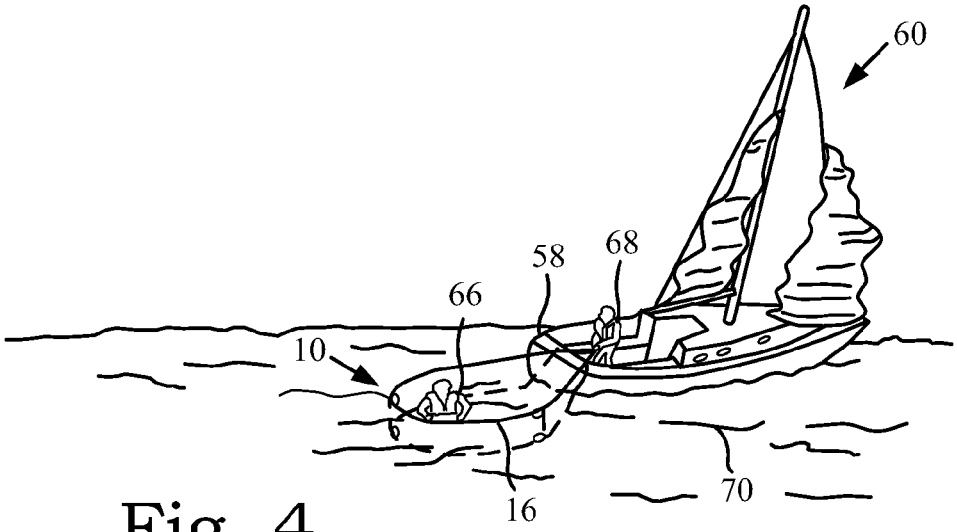
FIG. 4 is a perspective view of the embodiment of a boat with a crew overboard retrieval system of FIG. 2, as the crew overboard is being hauled towards the boat.

As shown particularly in FIGS. 2–4, the present invention can include boat 60 with crew overboard retrieval system 10 attached therewith. Although boat 60 is shown as a sailboat, boat 60 can be at least any of the previously mentioned boat types. For ease of storage and use, crew overboard retrieval system 10 can include a storage bag with a retrieval hook, such as a grappling hook attached to a line or boat hook, which retrieval hook can be used to retrieve flotation device 14.

In use, crew overboard retrieval system 10 is used anytime the retrieval of a crew or person 66 is necessary, to practice a crew overboard drill and/or to retrieve other animate or inanimate objects from the water. Loose section 38 of line 18 is attached to boat 60 prior to the deployment of crew overboard retrieval system 10, for example, and/or may be left attached at all or appropriate times. Similarly, crew overboard retrieval system 10 can be left on deck at all or appropriate times for ease of deployment. In the event that a crewmember 66 goes overboard, crew overboard retrieval system 10 is deployed by onboard crew 68, preferably before the distance from overboard crewmember 66 to boat 60 becomes about one and one half boat lengths, and flotation device 14 is dropped in water 70. Person 66 is encircled by net 16 using boat 60 to maneuver net 16 as crew overboard retrieval system 10 pays out, and net 16 is helped deploy if necessary, as boat 60 returns to the vicinity of flotation device 14. Flotation device 14 is retrieved with care not to pass over any part of crew overboard retrieval system 10 with boat 60. Boat 60 is brought to a stop, as much as is possible given sea and wind conditions, flotation device 14 is captured, by onboard crew 68, and both line 18 and float pole line 16 are pulled together preferably making sure overboard crew 66 is in net 16 and not in the lines. Care must be taken when hauling person 66 to boat 60 to not pull, or at least minimize pulling of, crew overboard retrieval system 10 with boat or retrieve crew overboard retrieval system 10 too quickly, if at all possible, so as not to drag overboard crew 66 through water 70. As overboard crew 66 is brought alongside boat 60, overboard crew 66 is helped or hoisted aboard boat 60 if possible. Alternatively, a halyard or other line is attached to two to four points of net 16 around overboard crew 66 to retrieve them. Drogue 56, if used, can aid in the retrieval of crew 66 by slowing a drift of flotation device 14. If crewmember 66 has drifted substantially away from boat 60 before deployment of crew overboard retrieval system 10, and/or boat 60 has moved substantially away from crewmember 66 before deployment, boat 60 is returned near to overboard crewmember 66 as quickly as possible and crew overboard retrieval system 10 is then deployed.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A crew overboard retrieval system for retrieving an object in the water, comprising:

a flotation device;

a net connected to said flotation device; and a line connected to said net, wherein said net includes an upper extent and a lower extent opposite said upper extent; said line includes a loose section, a top section connected to said upper extent and a bottom section connected to said lower extent; at least one net float connected to said upper extent; and at least one net ballast connected to said lower extent.

2. The crew overboard retrieval system of claim 1, wherein said loose section, said top section and said bottom section are connected at a Y junction.

3. A crew overboard retrieval system for retrieving an object in the water, comprising:

a flotation device;

a net connected to said flotation device;

a line connected to said net, wherein said net includes an upper extent and a lower extent opposite said upper extent; at least one net float connected to said upper extent; at least one net ballast connected to said lower extent; and at least one deployment tube connected to said net, at least one said net float and at least one said net ballast comprising at least one float-ballast pair, at least one said deployment tube being positioned between at least one said float-ballast pair.

4. A crew overboard retrieval system for retrieving an object in the water, comprising:

a flotation device;

a net connected to said flotation device;

a line connected to said net; and a second line connecting said net to said flotation device, wherein said net includes an upper extent and a lower extent opposite said upper extent, said second line includes a float device section connected to said flotation device, a second top section connected to said upper extent and a second bottom section connected to said lower extent.

5. The crew overboard retrieval system of claim 4, wherein said flotation device section, said second top section and said second bottom section are connected at a Y junction.

6. A crew overboard retrieval system for retrieving an object in the water, comprising:

a flotation device;

a drogue connected to said flotation device;

a net connected to said flotation device; and a line connected to said net, wherein said net includes an upper extent and a lower extent opposite said upper extent; at least one net float connected to said upper extent; and at least one net ballast connected to said lower extent.

7. A boat, comprising:

a marine structure; and a crew overboard retrieval system attached to said marine structure, said crew overboard retrieval system including a flotation device, a net connected to said flotation device and a line connected to said net, wherein said net includes an upper extent and a lower extent opposite said upper extent; said line includes a loose section, a top section connected to said upper extent and a bottom section connected to said lower extent; at least one net float connected to said upper extent; and at least one net ballast connected to said lower extent.

8. The boat of claim 7, wherein said loose section, said top section and said bottom section are connected at a Y junction.

9. A boat, comprising:

a marine structure; and a crew overboard retrieval system attached to said marine structure, said crew overboard retrieval system including a flotation device, a net connected to said flotation device and a line connected to said net, wherein said net includes an upper extent and a lower extent opposite said upper extent; at least one net float connected to said upper extent; at least one net ballast connected to said lower extent; and at least one deployment tube connected to said net, at least one said net float and at least one said net ballast comprising at least one float-ballast pair, at least one said deployment tube being positioned between at least one said float-ballast pair.

10. A boat, comprising:

a marine structure;

a crew overboard retrieval system attached to said marine structure, said crew overboard retrieval system including a flotation device, a net connected to said flotation device and a line connected to said net; and a second line connecting said net to said flotation device, wherein said net includes an upper extent and a lower extent opposite said upper extent; at least one net float connected to said upper extent; and at least one net ballast connected to said lower extent.

11. A boat, comprising:

a marine structure; and a crew overboard retrieval system attached to said marine structure, said crew overboard retrieval system including a flotation device, a net connected to said flotation device, a line connected to said net, and a second line connecting said net to said flotation device, wherein said net includes an upper extent and a lower extent opposite said upper extent, said second line includes a float device section connected to said flotation device, a second top section connected to said upper extent and a second bottom section connected to said lower extent.

12. The boat of claim 11, wherein said flotation device section, said top section and said bottom section are connected at a Y junction.

13. A boat, comprising:

a marine structure; and a crew overboard retrieval system attached to said marine structure, said crew overboard retrieval system including a flotation device, a drogue connected to said flotation device, a net connected to said flotation device and a line connected to said net, wherein said net includes an upper extent and a lower extent opposite said upper extent; at least one net float connected to said upper extent; and at least one net ballast connected to said lower extent.

14. A method of retrieving an object in the water, comprising the steps of:

providing a crew overboard retrieval system including a flotation device, a net connected to said flotation device and a line connected to said net;

connecting said line to a marine structure on a boat;

deploying said crew overboard retrieval system in the water by casting off said flotation device and said net;

maneuvering said boat to at least partially encircle the object in the water with said net;

capturing said flotation device; and retrieving the object in the water with said net.

15. The method of claim 14, wherein the object is a person.

16. The method of claim 14, further including the step of attaching a drogue to said flotation device.

17. The method of claim 16, further including the step of slowing a drift of said flotation device with said drogue.

18. The method of claim 14, wherein said marine structure is a boat.

* * * * *